US007289870B2

(12) United States Patent
Manabu

(10) Patent No.: US 7,289,870 B2
(45) Date of Patent: Oct. 30, 2007

(54) KNITTING METHOD, KNITTING FABRIC, KNIT DESIGNING DEVICE AND KNITTING PROGRAM FOR INTARSIA PATTERN

(75) Inventor: Yui Manabu, Wakayama (JP)

(73) Assignee: Shima Seiki Manufacturing, Ltd., Wakayama-shi, Wakayama (JP)

( * ) Notice: Subject to any disclaimer, the term of this patent is extended or adjusted under 35 U.S.C. 154(b) by 0 days.

(21) Appl. No.: 10/589,397

(22) PCT Filed: Feb. 9, 2005

(86) PCT No.: PCT/JP2005/001900

§ 371 (c)(1),
(2), (4) Date: Aug. 15, 2006

(87) PCT Pub. No.: WO2005/078179

PCT Pub. Date: Aug. 25, 2005

(65) Prior Publication Data

US 2007/0168076 A1 Jul. 19, 2007

(30) Foreign Application Priority Data

Feb. 17, 2004 (JP) ..... 2004-040490

(51) Int. Cl.
*G06F 19/00* (2006.01)

(52) U.S. Cl. ..... 700/141; 66/128; 66/232

(58) Field of Classification Search ..... 700/130, 700/131, 141; 66/64, 128, 127, 231, 232, 66/237

See application file for complete search history.

(56) References Cited

U.S. PATENT DOCUMENTS

| | | | | |
|---|---|---|---|---|
| 5,369,966 | A * | 12/1994 | Morita et al. | 66/132 R |
| 5,557,527 | A * | 9/1996 | Kotaki et al. | 700/131 |
| 6,047,570 | A * | 4/2000 | Shima | 66/126 R |
| 6,880,367 | B2 * | 4/2005 | Suzuki | 66/232 |
| 6,966,202 | B2 * | 11/2005 | Okuno | 66/64 |

FOREIGN PATENT DOCUMENTS

| | | |
|---|---|---|
| JP | 61-51061 B2 | 11/1986 |
| JP | 7-324259 A | 12/1995 |
| JP | 2916990 B2 | 7/1999 |
| WO | WO 02/097178 A | 12/2002 |

* cited by examiner

*Primary Examiner*—Danny Worrell
(74) *Attorney, Agent, or Firm*—Rothwell, Figg, Ernst & Manbeck, P.C.

(57) ABSTRACT

A yarn feeder is caused to perform a single reciprocating motion in a section in which the boundary of an intarsia pattern varies discontinuously such that a jump occurs between a yarn feeding end position of the yarn feeder and a following yarn feeding start position, and thus the stitches of the section in question are formed in halves between an outward route and a return route. As a result, yarn jumps do not occur even when the boundary of the intarsia pattern varies discontinuously.

12 Claims, 10 Drawing Sheets

AFTER PERFORMING KNITTING IN
(A) ORIGINAL LEADING PART AND
(B) TRAILING PART,
C. LEADING CARRIER IS KICKED BACK
TO PERFORM KNITTING IN INCREASED PART
OF FOLLOWING COURSE

Fig. 8

(a) ORIGINAL PATTERN

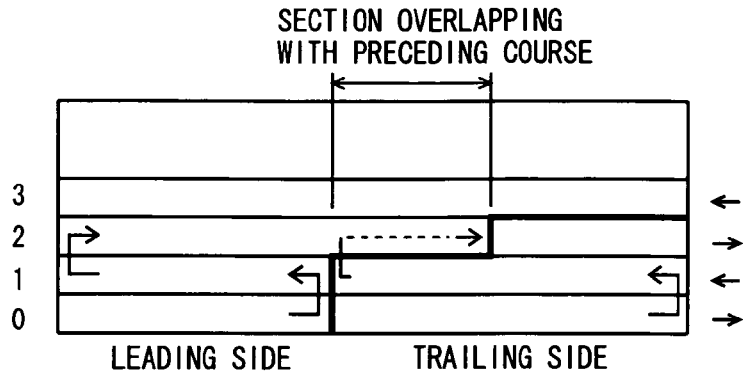

(b) DEVELOPED PATTERN (NO KICKBACK)

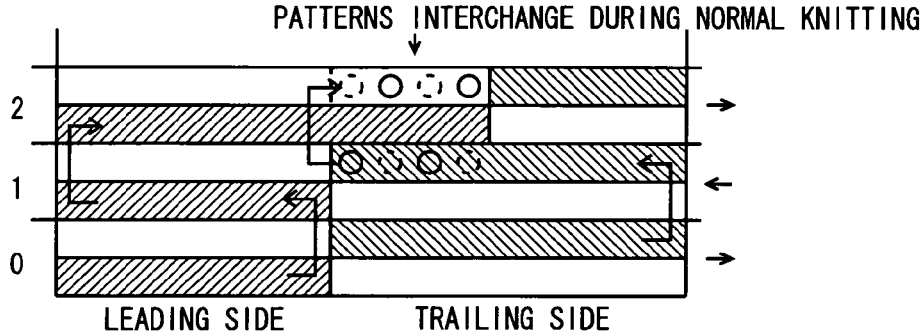

(c) DEVELOPED PATTERN (KICKBACK PERFORMED)

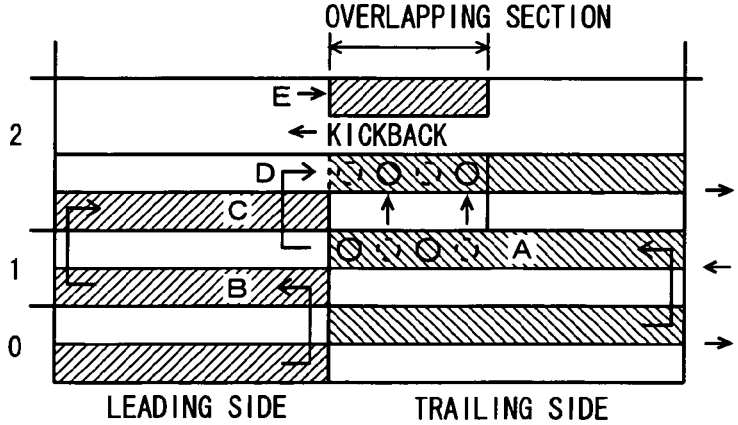

(C) KNITTING IS PERFORMED UP TO PART WHICH DOES NOT OVERLAP WITH PRECEDING COURSE IN LEADING PART OF CURRENT COURSE.
(D) KNITTING IS PERFORMED IN OVERLAPPING SECTION CORRESPONDING TO PREVIOUS COURSE, AND REMAINDER OF TRAILING PART IS KNITTED.
(E) LEADING CARRIER IS KICKED BACK TO KNIT REMAINING PART OF LEADING SIDE.

A－B－C－D－E

Prior Art

KNITTING METHOD, KNITTING FABRIC, KNIT DESIGNING DEVICE AND KNITTING PROGRAM FOR INTARSIA PATTERN

CROSS REFERENCE TO RELATED APPLICATION

This application is a 35 USC § 371 National Phase Entry Application from PCT/JP2005/001900, filed Feb. 9, 2005, and designating the United States.

1. Technical Field

This invention relates to intarsia pattern knitting, and more particularly to processing performed when the boundary of the intarsia pattern varies discontinuously.

2. Background Art

In intarsia knitting, a plurality of yarn feeders are used to express color patterns and the like using yarn of different colors, for example. The boundary between the patterns is connected by tuck stitches. The yarn feeders are connected and released by a carriage, and a carriage comprising two or more cam systems, for example, is used such that two yarn feeders are controlled by a leading cam system and a trailing cam system. When the pattern boundary varies discontinuously during intarsia knitting, the yarn feeding end position of the yarn feeder on the current course and the yarn feeding start position on the following course differ in the knitting course direction. In other words, the yarn feeding end position of the yarn feeder on the previous course and the yarn feeding start position on the following course jump discontinuously. Hence, in the intervening section, the yarn runs along the rear side of the knitting fabric or the like. A situation in which the yarn runs along the rear side of the knitting fabric is known as a yarn jump.

FIGS. 11 and 12 show a yarn jump at the boundary of an intarsia pattern. In FIG. 11, a pattern A and a pattern B are intarsia knitted using yarn of different colors, and a protruding portion 105 in which the pattern A protrudes from the pattern A into the pattern B is assumed to exist at a single stitch width in the course direction. The yarn feeder for the pattern A moves along a track 102 in the drawing, and the yarn feeder for the pattern B moves along a track 104 in the drawing. Once the yarn feeder for the pattern A has completed yarn feeding at the tip end of the protruding portion 105, yarn feeding resumes on the next course from a position which jumps to the left side in FIG. 11, and hence a yarn jump 106 occurs therebetween. Similarly, the yarn feeder for the pattern B jumps from a yarn feeding end position on the course immediately preceding the protruding portion 105 to a yarn feeding start position on the right side of the protruding portion 105, and hence a yarn jump 108 occurs therebetween. The yarn jumps are not eliminated by reversing the movement direction of the yarn feeders. For example, if the tracks of the yarn feeders are left-right reversed from those shown in FIG. 11, a yarn jump occurs in relation to the yarn feeder for the pattern A between the course immediately preceding the protruding portion 105 and the right end of the protruding portion 105, while a yarn jump occurs in relation to the yarn feeder for the pattern B between the right end of the protruding portion 105 and the base of the protruding portion 105 on the next course.

Yarn jumps are not limited to examples such as that shown in FIG. 11, and also occur when the pattern boundary jumps discontinuously. FIG. 12 shows an example of this. As the pattern boundary jumps, yarn jumps 110, 112 occur. Yarn jumps occurring on the rear side of the knitting fabric easily become caught in the fingers, causing damage to the knitting fabric, and are also unattractive when the knitting fabric is viewed from the rear. In the case of the yarn jump 110 in FIG. 12, the yarn feeder moves in a U shape, and hence the next course cannot be knitted easily unless the tip end of the yarn jump 110 on the pattern B side is fixed with a tuck stitch or the like. When a plurality of tuck stitches are provided in the yarn jump locations such that the yarn jumps are fixed by the tuck stitches, the fingers easily become caught in the gaps between widely-spaced tuck stitches, and if the tuck stitch intervals are narrow, the tuck stitch stitches may come undone when the needle is raised during the next knit.

Japanese Examined Patent Application Publication S61-51061 discloses a yarn feeder structure for intarsia knitting. Japanese Patent Publication No. 2916990 discloses a method of designing a knitting fabric including an intarsia pattern and a weave pattern.

DISCLOSURE OF THE INVENTION

An object of this invention is to prevent yarn jumps even when the boundary of an intarsia pattern varies discontinuously.

Secondary object of this invention is to provide a specific knitting method for achieving the above object.

Secondary object of this invention is to prevent yarn jumps even when one pattern protrudes into another pattern by a single stitch width in the course direction.

Secondary object of this invention is to prevent disruption to a pattern when knitting with another yarn feeder is interposed during the formation of a single course of stitches in both an outward route and a return route.

In the invention, a knitting method for an intarsia pattern is executed in a section on a boundary of the intarsia pattern in which a yarn feeding end position of a yarn feeder on a current course and a yarn feeding resumption position of the yarn feeder on a following course differ in a knitting course direction. The method comprises the steps of:

performing smoothing knitting by causing the yarn feeder to perform a reciprocating motion in the section such that on an outward route, a part of stitches of a single course in the section is formed, and on a return route, a remainder of the stitches of the single course in the section is formed, whereby the stitches of the single course in the section is formed by the sum total of the outward route and the return route; and ensuring that knitting with another yarn feeder is not performed in the section between the outward route and the return route of the smoothing knitting.

Preferably, knitting is performed with at least a leading yarn feeder and a trailing yarn feeder;

in a section in which a pattern to be knitted with at least one of the leading yarn feeder and the trailing yarn feeder increases in the knitting course direction from a current course to a following course, a part of stitches in the section is formed on a current knitting course, and a remainder of the stitches in the section is formed on a following knitting course; and in a section in which a pattern to be knitted with at least one of the leading yarn feeder and the trailing yarn feeder decreases in the knitting course direction from a current course to a following course, a part of stitches in the section is formed on a current knitting course, and a remainder of the stitches in the section is formed on a following knitting course.

Particularly preferably, in the section in which the pattern to be knitted with the leading yarn feeder increases in the knitting course direction from the current course to the following course, knitting on the current knitting course is performed excluding a part of stitches on the following course, whereupon the leading yarn feeder is returned and the part of the stitches of the following course is formed, and in the section in which the pattern to be knitted with the trailing yarn feeder decreases in the knitting course direction from the current course to the following course, the part of the stitches of the following course is formed on the following knitting course, whereupon the leading yarn feeder is returned and stitches of another following course in the section are formed by the leading yarn feeder.

Preferably, during knitting of the intarsia pattern in which a pattern A protrudes into a pattern B by a single stitch row width in a course direction, the smoothing knitting is performed by causing one yarn feeder selected from a pattern A yarn feeder and a pattern B yarn feeder to perform a reciprocating motion in a section corresponding to a length of the protruding portion, whereupon smoothing knitting is performed by causing the other yarn feeder of the pattern A yarn feeder and the pattern B yarn feeder to perform a reciprocating motion in the section corresponding to the length of the protruding portion.

In a knitting fabric for an intarsia pattern of the invention, the fabric has a section in which a boundary of the intarsia pattern varies discontinuously, and a course comprising a part of stitches in the section and a course comprising a remainder of the stitches in the section are both formed on a stitch row of a course preceding the section to form a single course of the stitches in the section by the sum total of the course comprising the part of the stitches in the section and the course comprising the remainder of the stitches in the section.

Preferably, a pattern A protrudes into a pattern B by a single stitch row width in a course direction, in a section corresponding to a length of the protruding portion, a row of stitches with one yarn of a pattern A yarn and a pattern B yarn is formed on a stitch row of a course preceding the section such that a course comprising a part of the stitches in the section and a course comprising a remainder of the stitches in the section to form a single course of the stitches in the section with the one yarn by the sum total of the course comprising the part of the stitches in the section and the course comprising the remainder of the stitches in the section, and a row of stitches with the other yarn of the pattern A yarn and the pattern B yarn is formed on a row of the single course of the stitches in the section with the one yarn such that a course comprising a part of stitches in the section and a course comprising a remainder of the stitches in the section to form a single course of the stitches in the section with the other yarn by the sum total of the course comprising the part of the stitches in the section and the course comprising the remainder of the stitches in the section.

This invention also provides a knit designing device for converting a knitting fabric design into a knitting method for a knitting machine. The device comprises:

detecting means for detecting a section on a boundary of an intarsia pattern in which a yarn feeding end position of a yarn feeder on a current course and a yarn feeding resumption position of the yarn feeder on a following course differ in a knitting course direction; and smoothing means for generating a smoothing knitting command to cause the yarn feeder to perform a reciprocating motion in the detected section such that on an outward route, a part of a single course of stitches in the section is formed, and on a return route, a remainder of the single course of the stitches in the section is formed, whereby the single course of the stitches in the section is formed by the sum total of the outward route and the return route.

Knitting with another yarn feeder is not performed in the section between the outward route and the return route.

A knitting program of this invention comprises:

detecting command for detecting a section on a boundary of an intarsia pattern in which a yarn feeding end position of a yarn feeder on a current course and a yarn feeding resumption position of the yarn feeder on a following course differ in a knitting course direction; and smoothing command for generating a smoothing knitting command to cause the yarn feeder to perform a reciprocating motion in the detected section such that on an outward route, a part of a single course of stitches in the section is formed, and on a return route, a remainder of the single course of the stitches in the section is formed, whereby the single course of the stitches in the section is formed by the sum total of the outward route and the return route.

Knitting with another yarn feeder is not performed in the section between the outward route and the return route.

Preferably, in the knit designing device and knitting program of this invention, knitting is performed with at least a leading yarn feeder and a trailing yarn feeder, a knitting command is generated such that in a section in which a pattern to be knitted with at least one of the leading yarn feeder and the trailing yarn feeder increases in the knitting course direction from a current course to a following course, a part of stitches in the section is formed on a current knitting course, and a remainder of the stitches in the section is formed on a following knitting course, and a knitting command is generated such that in a section in which a pattern to be knitted with at least one of the leading yarn feeder and the trailing yarn feeder decreases in the knitting course direction from a current course to a following course, a part of stitches in the section is formed on a current knitting course, and a remainder of the stitches in the section is formed on a following knitting course.

Particularly preferably, in the knit designing device and knitting program of this invention, a knitting command is generated such that in a section in which the pattern to be knitted with the leading yarn feeder increases in the knitting course direction from the current course to the following course, knitting on the current knitting course is performed excluding a part of stitches on the following course, whereupon the leading yarn feeder is returned and the part of the stitches on the following course is formed, and a knitting command is generated such that in the section in which the pattern to be knitted with the trailing yarn feeder decreases in the knitting course direction from the current course to the following course, the part of the stitches of the following course is formed on the following knitting course, whereupon the leading yarn feeder is returned and stitches of another following course in the section are formed by the leading yarn feeder.

In the knitting method and knitting fabric for an intarsia pattern according to this invention, approximately half of the stitches of a section in which the yarn feeding end position and yarn feeding start position of the yarn feeder differ in the knitting course direction are knitted above the row of stitches of the preceding course on an outward route of the yarn feeder during smoothing knitting, and these stitches are connected to each other in the wale direction (horizontal direction). Note that the term "differ in the knitting course direction" signifies a difference of at least one stitch, for example, but may signify a difference of two stitches or more, whereby a difference of one stitch is not considered as a difference. Further, in an embodiment, a difference in the knitting course direction between the yarn feeding end position and the yarn feeding start position is referred to as a pattern boundary jump or the like. The remaining approximately half of the stitches in this section is formed on the return route of the yarn feeder, and these stitches are connected in the wale direction. Hence, the two courses of stitches formed on the outward route and return route are formed at single stitch intervals, for example, and as a whole form a row of a single course of stitches. In the meantime, the yarn feeder moves to a position from which subsequent knitting can be performed. In this invention, an intarsia pattern having a pattern boundary which varies discontinuously can be knitted. As a result, problems such as fingers becoming caught in yarn running along the rear side of the knitting fabric, unattractiveness when the knitting fabric is viewed from the rear side, and so on can be solved. Moreover, since there are no yarn jumps, limitations on the design of the knitting fabric are reduced. Further, with the knit designing device and knitting program of this invention, the knitting operation described above can be executed on a knitting machine, and hence a knitting fabric including a section in which the yarn feeding start position and yarn feeding end position of the yarn feeder in an intarsia pattern are discontinuous can be knitted without yarn jumps.

Furthermore, with this invention a design in which one pattern protrudes into the other pattern by one stitch width in the course direction can be knitted without yarn jumps. Hence design limitations can be reduced.

Further, according to an aspect of this invention, smoothing knitting can be performed without inserting another yarn feeder between the outward route and return route (see FIGS. 4 to 6). This is particularly meaningful when the yarn feeder or carriage intrudes into a section in which a pattern using the leading or trailing yarn feeder increases from the tip end of the pattern increasing side. It is also particularly meaningful when the yarn feeder or carriage intrudes into a section in which the pattern decreases from the pattern decreasing side. For example, this is important when a pattern using the leading yarn feeder increases to the right side of the knitting course direction and the yarn feeder or carriage intrudes into this section from the right side. It is also important when the pattern retreats to the right side such that the left side section of the pattern decreases and the yarn feeder or carriage intrudes from the left side.

According to another aspect of this invention, when a kickback is performed to return the yarn feeder, the patterns can be prevented from interchanging when another yarn feeder is interposed between the outward route and return route, and moreover, the tuck stitch position at the intarsia pattern boundary can be prevented from deviating by one stitch in the course direction. Hence, the tuck stitch positions can be aligned such that the pattern boundary is clean (see FIGS. 4, 6, 7, 8).

BRIEF DESCRIPTION OF THE DRAWINGS

FIG. 8 is a knitting procedure diagram of this embodiment relating to a similar design to FIG. 7, in which the carriage movement direction is reversed, FIG. 8(*a*) showing the original design, FIG. 8(*b*) showing a knitting procedure in which a kickback is not performed, and FIG. 8(*c*) showing a knitting procedure in which a kickback is performed;

BRIEF DESCRIPTION OF THE SYMBOLS

| | |
|---|---|
| 2 | Knit designing device |
| 4 | Digitizer |
| 6 | Keyboard |
| 8 | Monitor |
| 10 | Color printer |
| 12 | LAN interface |
| 14 | Disk drive |
| 16 | Memory |
| 18 | Data conversion unit |
| 20 | Jump detection unit |
| 22 | Kickback determination unit |
| 24 | Smoothing knitting unit |
| 30 | Flat knitting machine |
| 40 | Knitting program |
| 42 | Jump detection command |
| 44 | Kickback determination command |
| 46 | Smoothing knitting command |
| 50 | Stitch row of preceding course |
| 52, 53 | Stitch produced by smoothing knitting |
| 60-64 | Pattern |
| 66 | Jump location at pattern boundary |
| 102 | Track of yarn feeder for pattern A |
| 104 | Track of yarn feeder for pattern B |
| 105 | Protruding portion |
| 106-112 | Yarn jump |

EMBODIMENT

An embodiment for carrying out the present invention will be described below.

Figure 1:
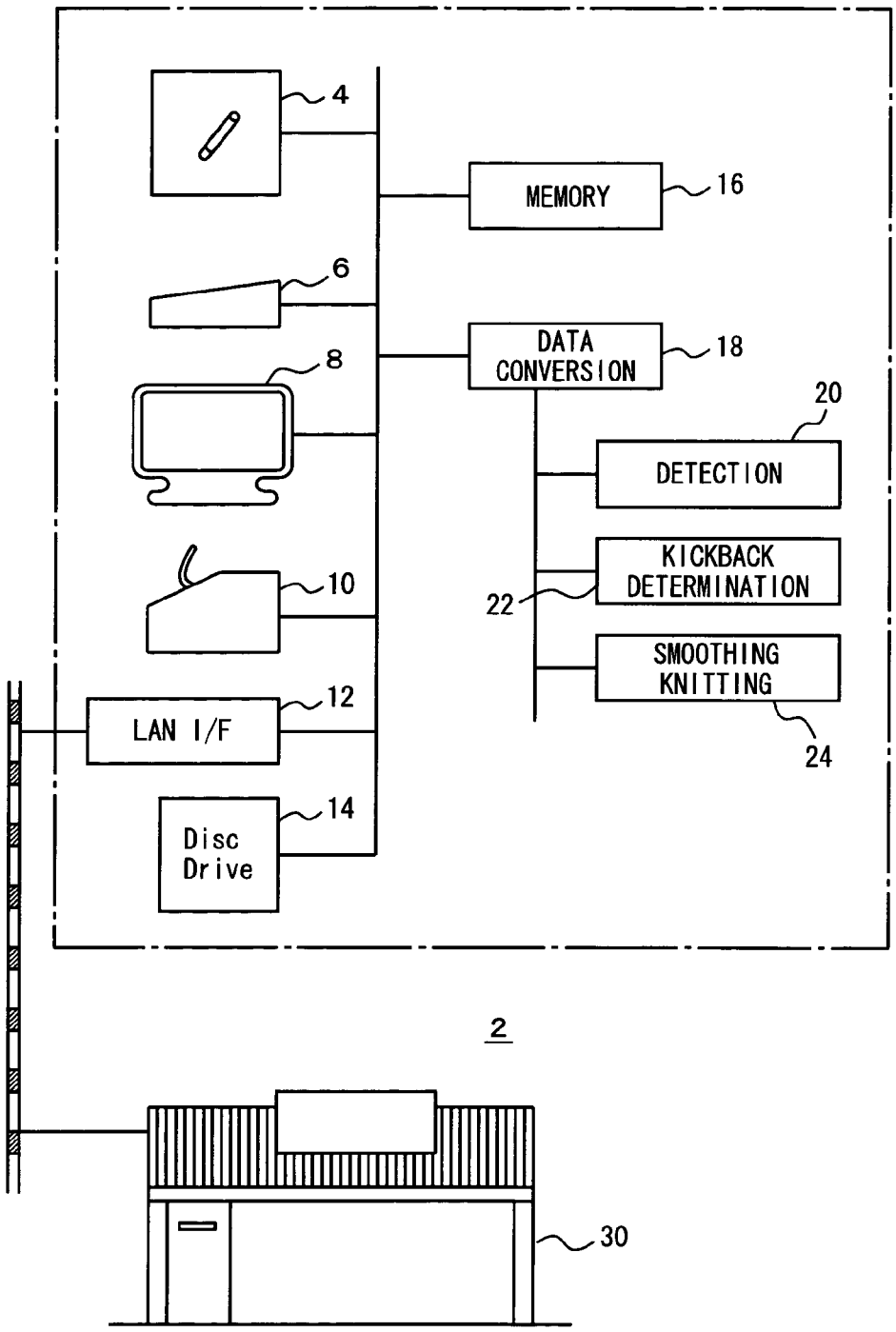
FIG. 1 is a block diagram showing a knit designing device according to an embodiment.

FIGS. 1 to 10 show an embodiment. FIG. 1 shows a knit designing device 2 according to this embodiment, in which 4 denotes image input means such as a digitizer, and 6 denotes input means such as a keyboard. 8 denotes a monitor which displays images of a knitting fabric during a design process or a designed knitting fabric, simulated images of the design, and so on, and also serves as a graphic user interface for receiving user input. 10 denotes a color printer which prints knitting fabric design data, simulation images thereof, and so on. 12 denotes a LAN interface which performs input/output of design images, knitting data, knitting programs, and so on, while a disk drive 14 similarly performs input/output of images, design data, simulation images, knitting programs, and so on via a disk.

16 denotes a memory which stores various data and programs such as design data, design images, and knitting programs, while 18 denotes a data conversion unit which converts knitting fabric design data into knitting data that can be knitted by a knitting machine such as a flat knitting machine. During conversion into knitting data, the design data may be converted into knitting data that can be executed immediately on an actual knitting machine, or the design data may be converted into knitting data for a virtual knitting machine serving as a slight abstraction of an actual knitting machine, and then converted into knitting data that can be executed by an actual knitting machine.

In this invention, processing is performed to eliminate yarn jumps when the boundary of an intarsia pattern varies discontinuously, and for this purpose, a jump detection unit 20, a kickback determination unit 22, and a smoothing knitting unit 24 are provided. The jump detection unit 20 detects a location in which the pattern boundary of an intarsia pattern jumps discontinuously. The detected course (the row of stitches in the horizontal direction of the knitting fabric) and the courses above and below become the processing subjects of smoothing knitting. The kickback determination unit 22 determines whether or not a kickback, to be described below, is necessary, and if so, modifies the knitting course sequence accordingly. Note that in this specification, a "knitting course" is different from a simple "course" in that a single carriage movement denotes one "knitting course". A "course" is a row of connected stitches in the horizontal direction which may be knitted by a plurality of knitting courses. Further, the course direction is orthogonal to a plurality of courses, for example the vertical direction of the knitting fabric. The wale direction is orthogonal to the wales, for example the horizontal direction of the knitting fabric. The smoothing knitting unit 24 generates a command to cause the corresponding yarn feeder to perform a reciprocating motion in relation to the section in which the yarn jump has occurred such that a row of stitches is formed in the section approximately half in the outward route and half in the return route, whereby a single course of stitches is formed in the section by the sum total of the outward route and the return route. This type of knitting is called as smoothing knitting. The knit designing device 2 supplies knitting data to a flat knitting machine 30 via a LAN, a disk, or similar, and thus a knitting fabric or the like including an intarsia pattern is knitted.

Figure 2:
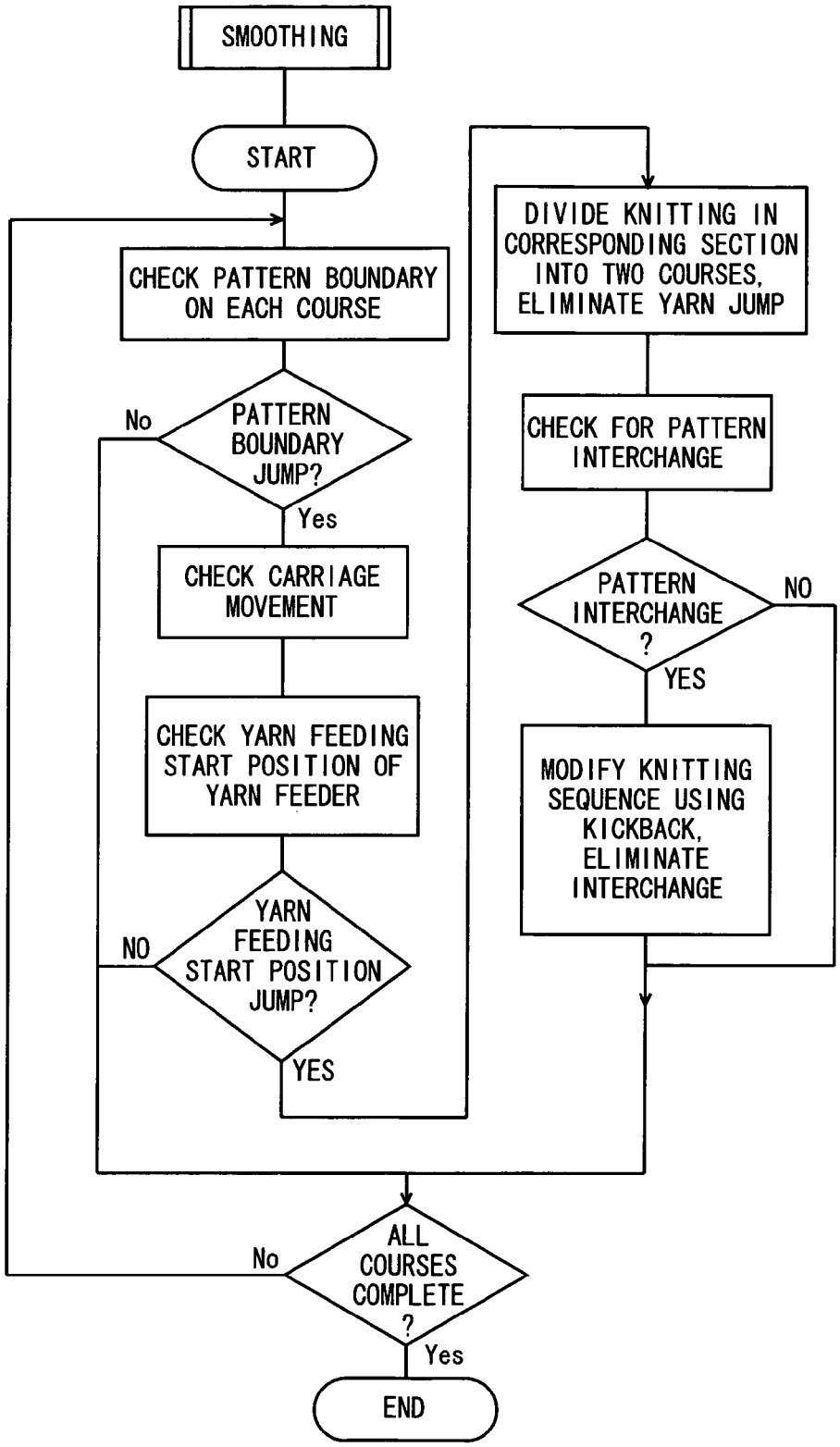
FIG. 2 is a flowchart showing a knitting algorithm of this embodiment.

FIG. 2 shows a knitting algorithm of this embodiment. Note that the algorithm of FIG. 2 only shows processing in a section in which the pattern boundary is processed discontinuously in an intarsia pattern. The pattern boundary of the intarsia pattern is checked course by course, for example, and the presence of a pattern boundary jump is detected. In a flat knitting machine, the carriage performs a reciprocating motion over the needle heads, and in accompaniment therewith, yarn feeders are connected or released such that yarn is supplied to the needle from the yarn feeders. Yarn feeders for intarsia knitting are preferably used, but normal yarn feeders may be used. With an intarsia knitting yarn feeder, the yarn feeding portion swings in an opposite direction to the advancement direction of the carriage following release, and thus the yarn from the yarn feeding portion can be prevented from hindering knitting of the next pattern. In contrast, when a normal yarn feeder is released, the yarn feeder must be moved to a position where it will not hinder knitting of the next pattern using the carriage or the like, leading to a decrease in knitting efficiency. Note that a movement to remove a yarn feeder to a position where it will not hinder knitting bears no relation to the outward route and return route of the smoothing knitting performed in the present invention. Further, measures may be taken such that the yarn feeder is only moved when connected to the carriage, or an auxiliary mechanism may be provided to move the yarn feeder separately to the carriage such that carriage connection and the yarn feeder movement mechanism are used in conjunction with each other. Furthermore, when there are no jumps on the pattern boundary, knitting may be performed in accordance with a normal knitting method.

On a knitting course having a pattern boundary jump and the knitting courses above and below, for example, the carriage movement, the yarn feeding start position of the yarn feeder, and the connection release position are checked to determine whether or not a jump (a discontinuous movement) occurs in the position of the yarn feeder between the connection release position and the next yarn feeding start position. When no jump exists, a yarn jump does not occur. When the yarn feeding start position jumps such that a jump occurs between the connection release position and the yarn feeding start position of the yarn feeder, the corresponding section becomes a section in which a yarn jump exists. In this section, knitting is divided into two courses, an outward route and a return route, and the stitches in the section are knitted in halves to eliminate the yarn jump. This type of knitting, in which division into an outward route and a return route is performed, is known as smoothing knitting. In smoothing knitting, the yarn feeder is connected until the connection release position, and knitting is performed normally in this section. The yarn feeder is then moved to the connection resumption position of the next course, and during this movement, outward route smoothing knitting is performed. Thereafter, return route smoothing knitting can be performed. This is effective in a case where the section knitted by the yarn feeder widens. Alternatively, outward route smoothing knitting may be performed as the yarn feeder is moved to the connection release position and return route smoothing knitting may be performed as the yarn feeder is moved to the next connection start position. This is effective in a case where the section knitted by the yarn feeder narrows.

During smoothing knitting constituted by the outward route and return route, if knitting is performed using another yarn feeder in the same section, the stitch row produced by the other yarn feeder intrudes into the stitch row of the course, leading to pattern interchange. Hence, a determination is made as to whether or not yarn is to be fed by another yarn feeder into a section in which smoothing knitting constituted by an outward route and a return route is performed, and if so, the knitting sequence is modified using a kickback. Alternatively, the leading yarn feeder and trailing yarn feeder are switched. In so doing, the pattern interchange is eliminated. Incidentally, in the case of an intarsia pattern, a tuck stitch is performed before forming the first stitch upon the resumption of yarn feeding, and thus the stitches of the course to be knitted are connected to the row of stitches of the adjacent, knitted pattern. By switching the leading yarn feeder and trailing yarn feeder, the course knitting sequence is switched, and hence the position of the tuck stitch deviates by one stitch in the course direction. When a kickback is performed, the tuck stitch position does not deviate, and the tuck stitch positions are disposed regularly such that the connecting stitches of the intarsia pattern can be produced cleanly. When the processing described above is performed on all of the courses, for example, yarn jumps caused by discontinuous jumping of the pattern boundary can be eliminated.

Figure 3:
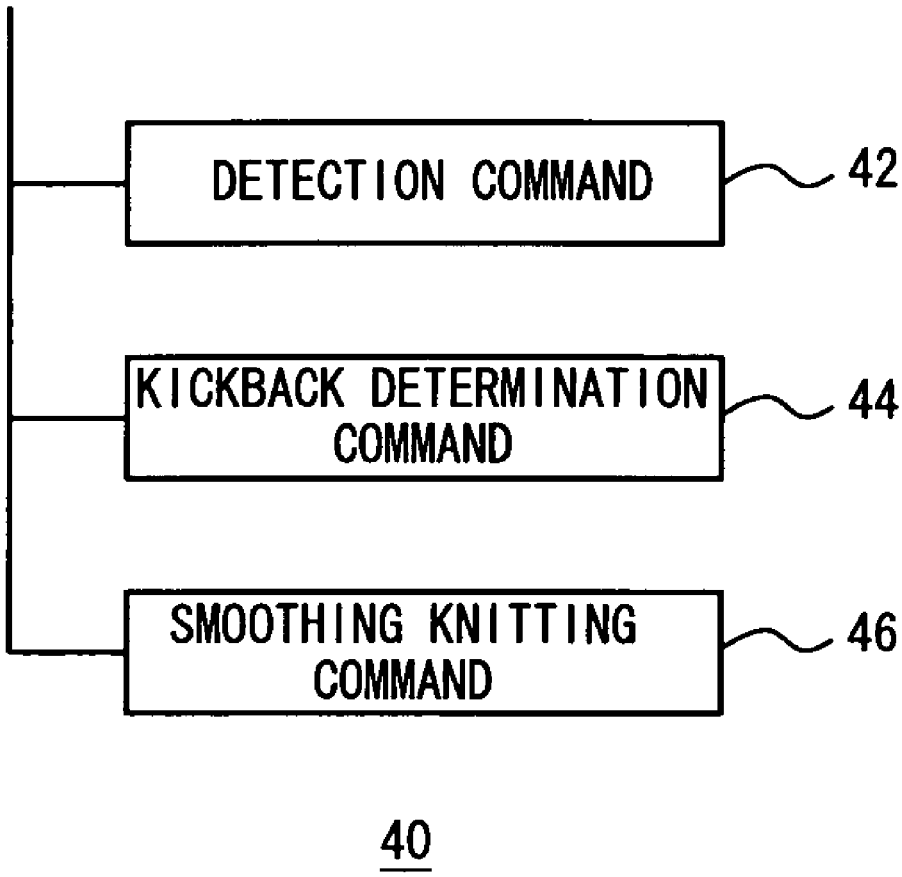
FIG. 3 is a block diagram showing a knitting program of this embodiment.

FIG. 3 shows a knitting program 40 of this embodiment. A jump detection command 42 detects a location in which the pattern boundary of the intarsia pattern varies discontinuously, and when such a location is detected, the need for a kickback is determined by a kickback determination command 44. Further, when a kickback is required, the kickback determination command 44 modifies the knitting sequence. A smoothing knitting command 46 generates knitting commands for moving the carriage, connecting and releasing the yarn feeders, operating the needles, and so on during the smoothing knitting.

Figure 4:
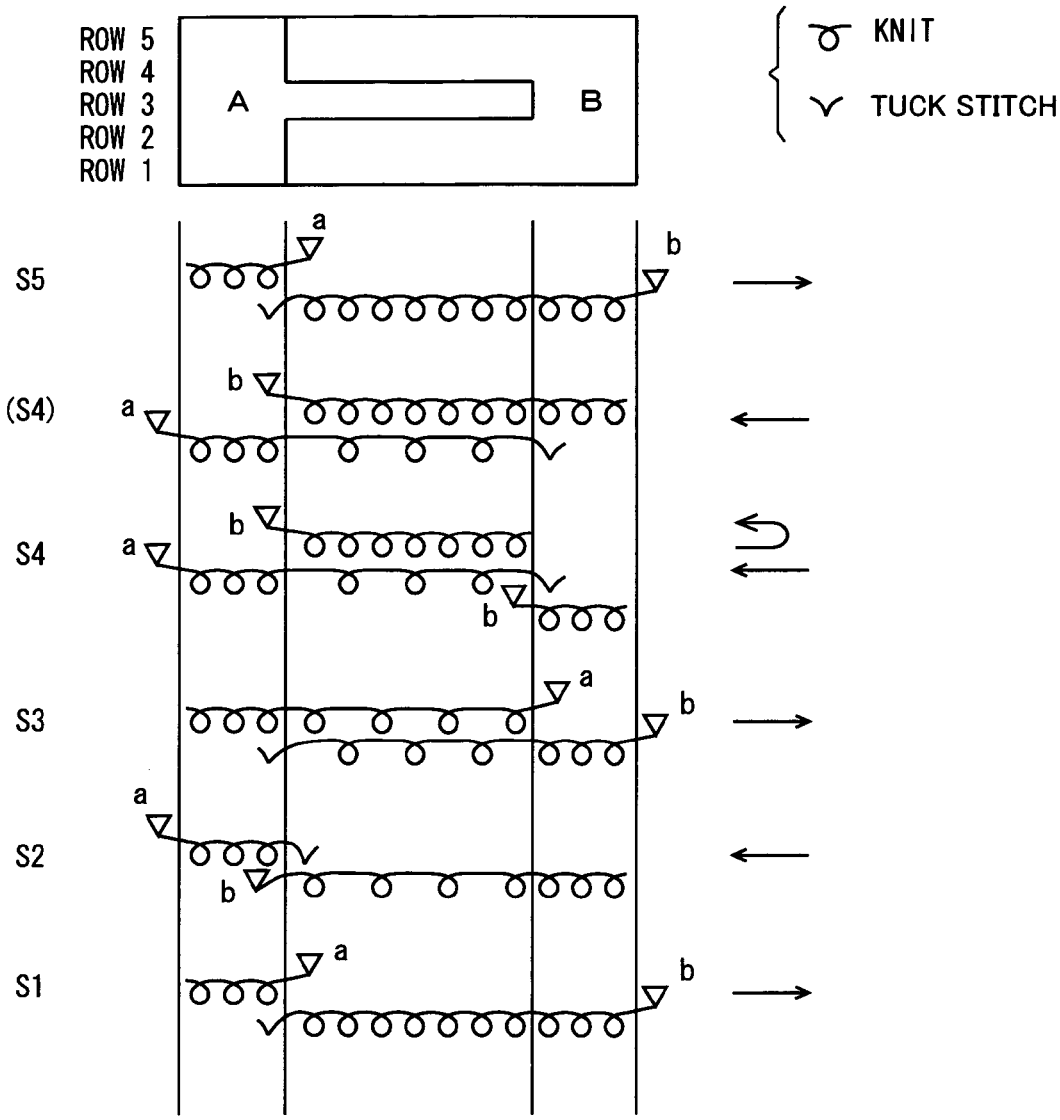
FIG. 4 is a knitting procedure diagram of a design in which a pattern A protrudes into a pattern B by a single stitch width, according to this embodiment.
Figure 5:
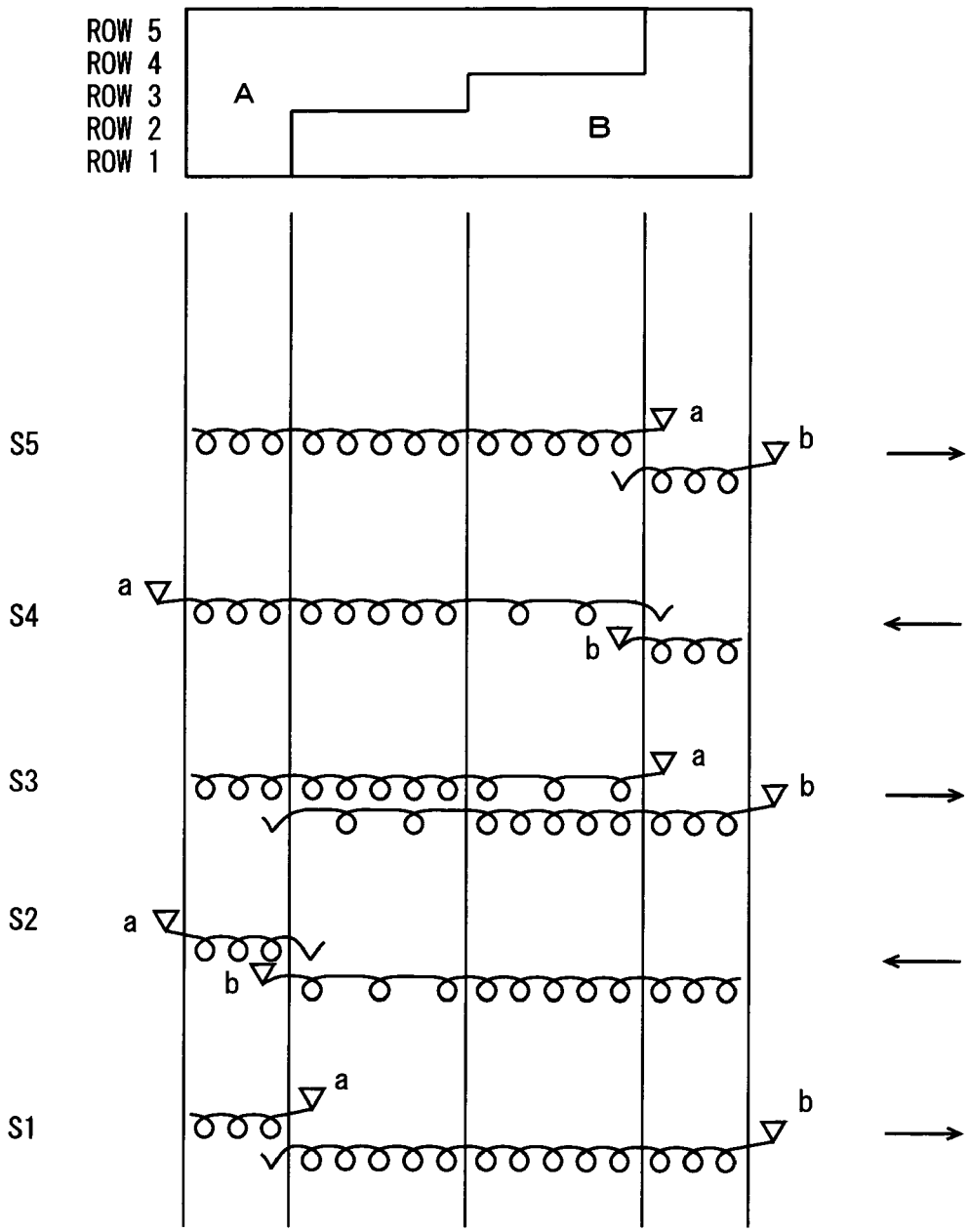
FIG. 5 is a knitting procedure diagram of a design in which a boundary between a pattern A and a pattern B jumps, according to this embodiment.
Figure 6:
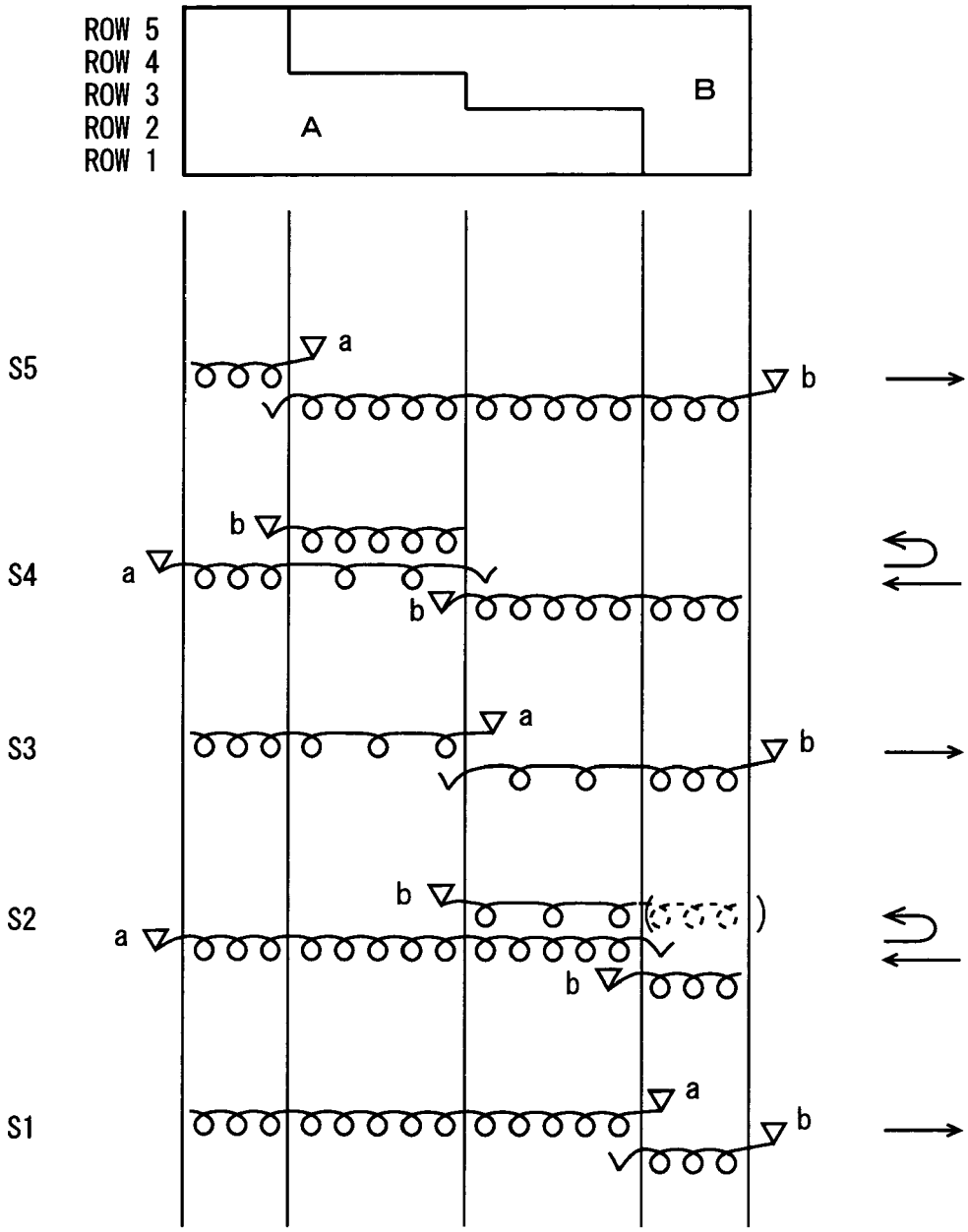
FIG. 6 is a knitting procedure diagram relating to a design in which the range of the pattern B increases in an opposite manner to that shown in FIG. 5, according to this embodiment.

FIGS. 4 to 6 show examples of smoothing knitting. In FIGS. 4 to 6, the symbols a and b denote the yarn feeders for the respective patterns A and B, while the symbols relating to knit and tuck stitch stitches are shown in the top right corner of FIG. 4. Symbols such as S1 to S5 denote the knitting courses (steps) of the carriage, beginning at a step 1 and advancing to a step 5. The symbol (S4) in FIG. 4 denotes a knitting course that may be performed in place of a step 4. The arrows show the movement direction of the carriage. The yarn feeder shown on the lower side of each course is the leading yarn feeder which is driven by the leading cam system of the carriage, while the yarn feeder shown on the upper side is the trailing yarn feeder which is driven by the trailing cam system of the carriage.

In the knitting fabric of FIG. 4, the pattern A protrudes into the pattern B by a single stitch row width on the third course. In FIG. 4, smoothing knitting is performed using the yarn feeder b in the steps 2 and 3, while smoothing knitting is performed by the yarn feeder a in the steps 3 and 4. Knitting is performed with the yarn feeder b as the leading yarn feeder in the step 1, and then approximately half of the stitches in the section in which the pattern A protrudes is formed in the step 2. The remaining stitches of this section are then knitted by the yarn feeder b in the step 3. The yarn feeder a only contributes tuck stitches to the section in which smoothing knitting is performed. On the trailing side of the step 3, the yarn feeder a is used to perform knitting on the outward route of the smoothing knitting, and in the step 4, the yarn feeder a is used as the leading yarn feeder to perform knitting on the return route of the smoothing knitting.

In the step 4, knitting is begun with the yarn feeder b leading and the yarn feeder a trailing. The yarn feeder b is released partway and one course is knitted by the yarn feeder a. A kickback is then performed by reversing the carriage while empty such that a knitting operation is not performed and connecting the yarn feeder b, which is moved slightly back. The carriage is the reversed, whereupon the yarn feeder b is reconnected and the remaining section is knitted. Thus, knitting by the yarn feeder b is prevented from interfering between the outward route and return route of the smoothing knitting. Note that instead of knitting using a kickback as described above, the yarn feeder a may lead and the yarn feeder b may trail for the entire section of the course, as shown in (S4) of FIG. 4. In this case, the position of the tuck stitch formed by the yarn feeder a is above the stitches of the pattern B formed in the step 3 of the previous course, and hence the tuck stitch position deviates by one stitch in the course direction. In the knitting shown in FIG. 4, knitting can be performed without yarn jumps on a design in which one of the patterns protrudes into the other pattern by a single stitch width in the course direction.

FIG. 5 shows an example in which the boundary between the pattern A and the pattern B varies in small widths, for example. The knitting of the step 1 is performed with the yarn feeder b leading, and outward route smoothing knitting is performed by the yarn feeder b on the row of stitches of the following course in the step 2. In the step 3, the yarn feeder b is used to perform return route smoothing knitting, and outward route smoothing knitting is performed by the trailing yarn feeder a. Return route smoothing knitting is then performed by the yarn feeder a in the step 4. In so doing, knitting can be performed without yarn jumps on a design in which the boundary between the pattern A and the pattern B jumps discontinuously.

FIG. 6 shows an opposite design to that shown in FIG. 5, in which the pattern B gradually protrudes into the pattern A. In this case, knitting is performed with the yarn feeder b leading. In the step 2, the yarn feeder b is released partway, and when knitting by the yarn feeder a is complete, for example, the yarn feeder b is kicked back by reversing the carriage while empty such that a knitting operation is not performed. The carriage is then reversed to reconnect the yarn feeder b, and the remainder of the section is knitted. Thus, outward route smoothing knitting is performed by the yarn feeder b, whereupon the yarn feeder b is returned to the leading position in the step 3 to perform return route smoothing knitting. In the step 2, as shown by the broken line in parentheses, the yarn feeder b may be operated as the trailing yarn feeder from the start. In the step 3, in addition to the return route smoothing knitting performed by the yarn feeder b, outward route smoothing knitting is performed by the yarn feeder a. Partway through the step 4, the yarn feeder a is switched to the leading yarn feeder a to perform return route smoothing knitting. Hence, in the step 4, the yarn feeder b begins as the leading yarn feeder and becomes the trailing yarn feeder partway.

Figure 7:
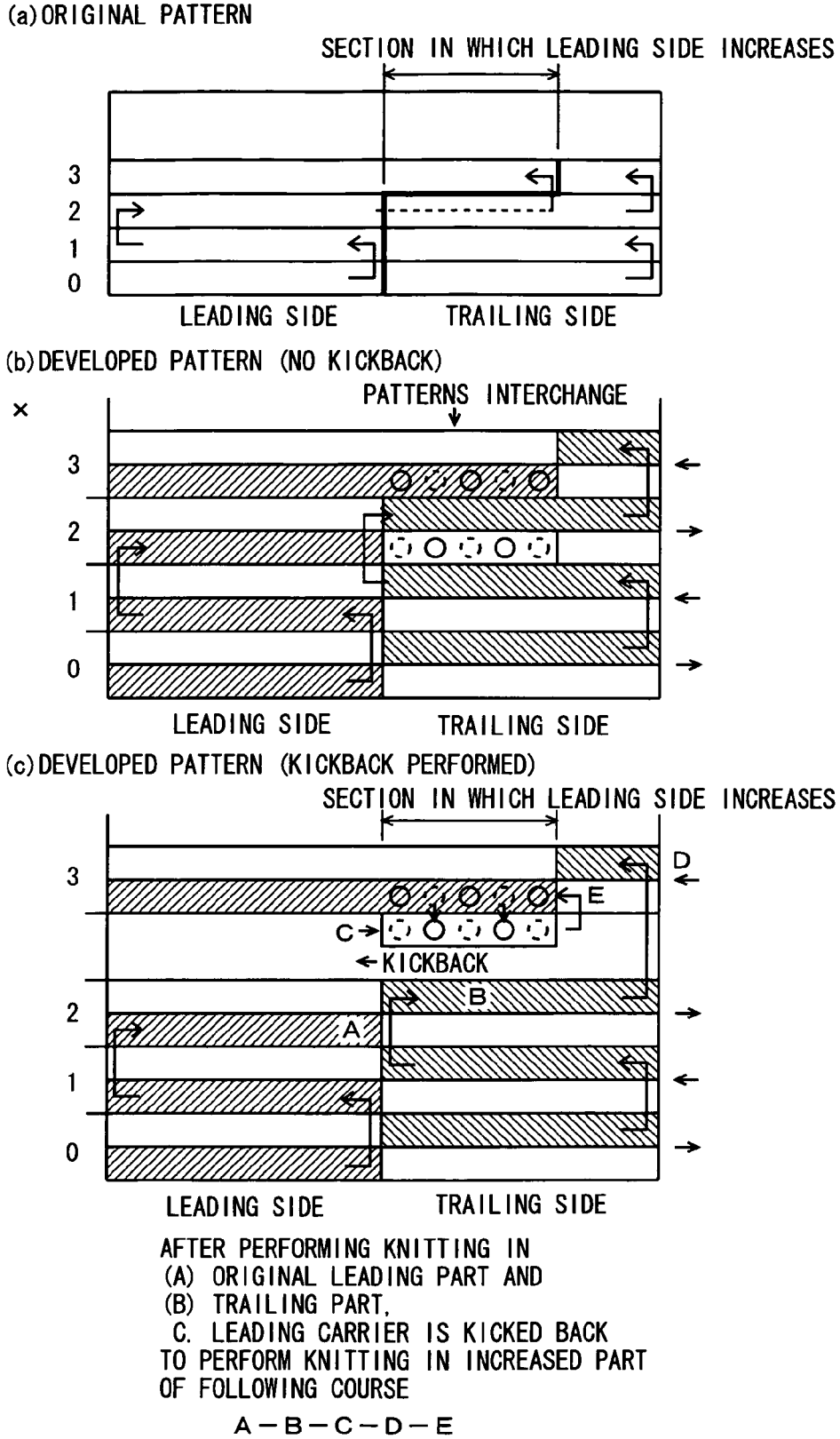
FIG. 7 is a knitting procedure diagram showing the prevention of pattern interchange using a kickback in this embodiment, FIG. 7(*a*) showing the original design, FIG. 7(*b*) showing a knitting procedure in which a kickback is not performed, and FIG. 7(*c*) showing a knitting procedure in which a kickback is performed.

FIGS. 7 and 8 show ways of preventing pattern interchange using a kickback. Note that pattern interchange can be prevented even when the leading/trailing order of the yarn feeders is changed, as shown in FIGS. 4 and 5. FIG. 7(*a*) shows the original design, FIG. 7(*b*) shows an example in which the design is developed into the operations of the yarn feeders and carriage without performing a kickback, and FIG. 7(*c*) shows an example in which a kickback is added. On a course 3, the left side pattern protrudes into the right side. As shown in FIG. 7(*b*), the yarn feeder for knitting the left side pattern is allocated as the leading yarn feeder and the yarn feeder for knitting the right side pattern is allocated as the trailing yarn feeder. The outward route of the smoothing knitting on the left side pattern is processed on the leading side of a course 2, and during processing of the return route on the course 3, yarn is fed to the same section from the trailing yarn feeder. As a result, a trailing stitch row is added to the stitches of the course such that the patterns interchange.

Therefore, a kickback is performed as shown in FIG. 7(*c*), and once courses 0 and 1 have been processed, the leading yarn feeder is used to knit a section A and the trailing yarn feeder is used to knit a section B. The carriage is then reversed while empty, i.e. without performing a knitting operation, to the starting position of a section C, whereupon the section C is knitted using the leading yarn feeder. This section is constituted by outward route smoothing knitting. Next, after a section D, for example, has been knitted, a section E is knitted using the leading yarn feeder. Note that the section D may be knitted after the section B, whereupon a kickback is performed and the sections C and E are knitted in sequence.

FIG. 8 shows a similar design to FIG. 7, but the movement direction of the carriage is reversed in the section (course 2) in which the pattern knitted by the leading side yarn feeder increases. In FIG. 8(*b*), outward route smoothing knitting is performed on the trailing side of course 1, and return route smoothing knitting is performed on the trailing side of course 2. However, on the leading side of course 2, the leading yarn feeder feeds yarn to the same section, leading to pattern interchange. Hence, a kickback is performed as shown in FIG. 8(*c*) to change the knitting sequence. Accordingly, a section B of course 1 is knitted by the leading yarn feeder, a section A is knitted by the trailing yarn feeder, and outward route smoothing knitting is performed in the latter half of the section A. A section C of course 2 is knitted by the leading yarn feeder, a section D is knitted by the trailing yarn feeder, and return route smoothing knitting is performed in the initial part of the section D. The carriage is then kicked back, whereupon the remaining section E is knitted.

Figure 9:
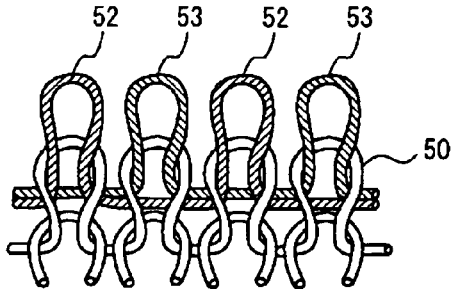
FIG. 9 is a view showing a knitting structure produced by smoothing knitting in this embodiment.
Figure 10:
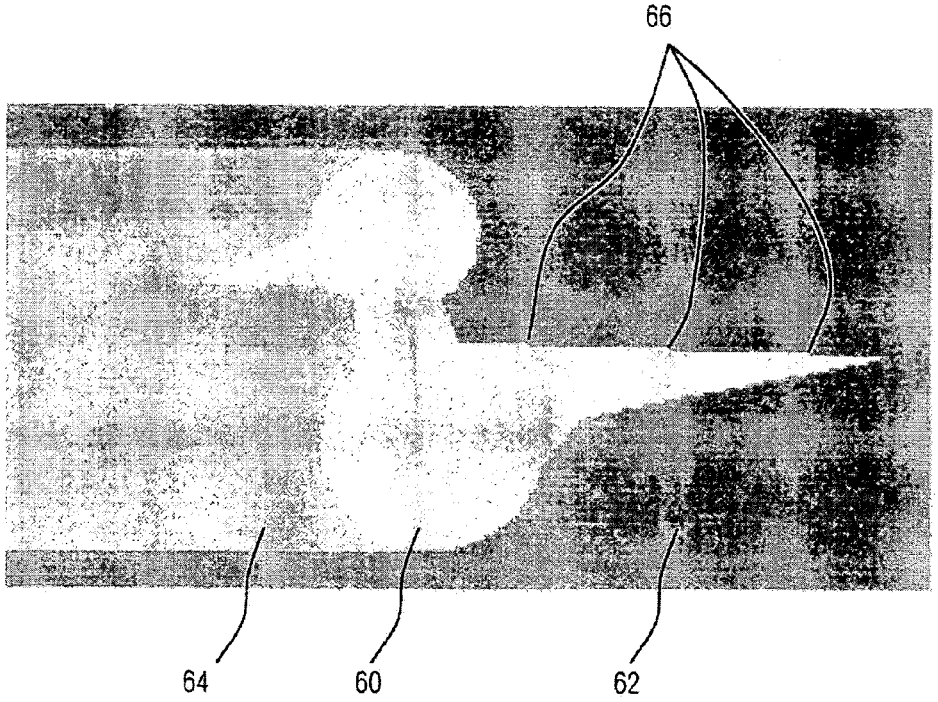
FIG. 10 is a view showing a design example of a knitting fabric suitable for the smoothing knitting, according to this embodiment.
Figure 11:
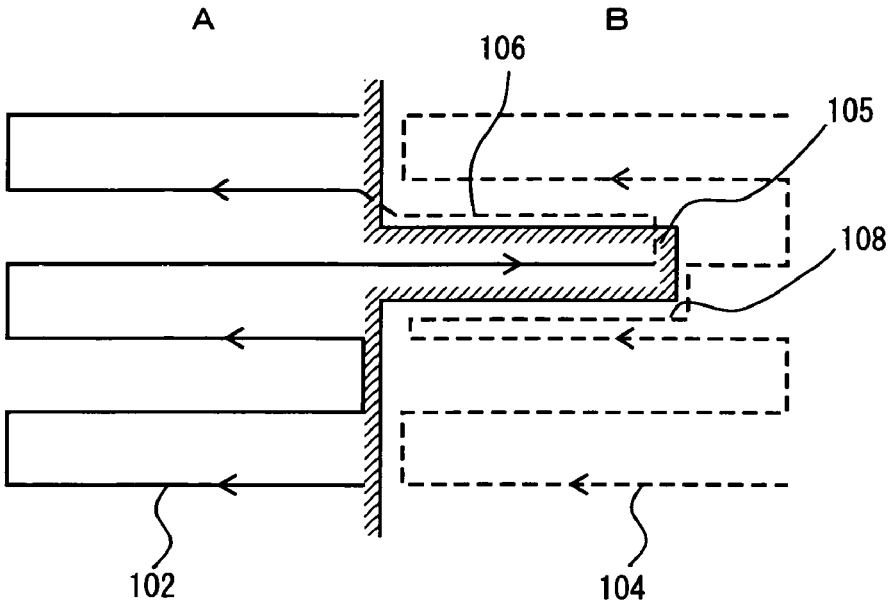
FIG. 11 is a view showing a yarn jump in a conventional example when a design in which a pattern A protrudes into a pattern B by a single stitch width is knitted.
Figure 12:
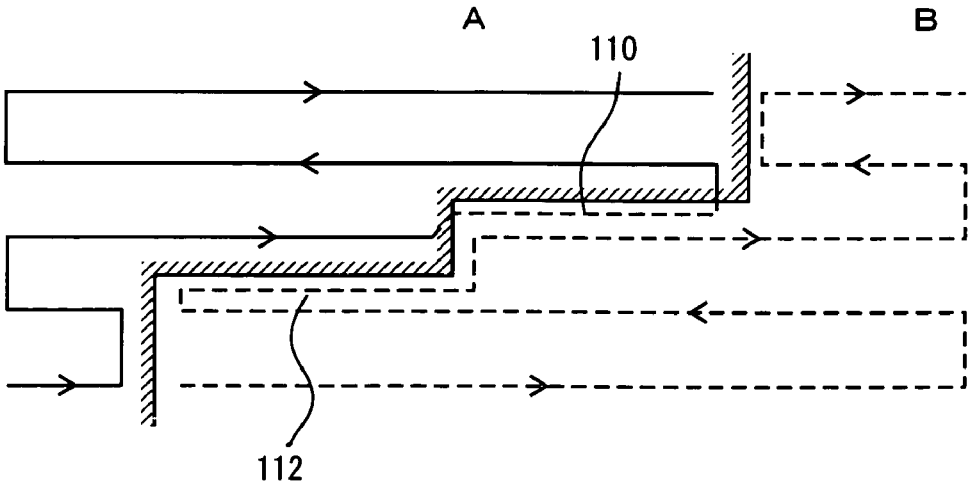
Prior Art Fig. 12
FIG. 12 is a view showing a yarn jump in a conventional example when a boundary between a pattern A and a pattern B jumps.

FIG. 9 is a pattern diagram showing a knitting fabric obtained through smoothing knitting. 50 denotes a stitch row of the course preceding the smoothing knitting, and 52, 53 denote stitches produced by the smoothing knitting. In the case shown in FIG. 9, the two stitches 52, 52 are knitted on either the outward route or the return route of the smoothing knitting, and the stitches 53, 53 are knitted on the other route. A slight yarn jump exists between the stitches 52 and 52 and between the stitches 53 and 53, but the range of the jump is too small to become caught in a finger or the like. FIG. 10 shows an example of a design suited to the intarsia knitting of this embodiment. 60, 62, and 64 denote patterns having different yarn types which are subjected to intarsia knitting. A jump location 66 or the like occurs at the pattern boundary, but knitting can be performed without yarn jumps even in such sections. In FIG. 9, the stitches 52, 53 occur at single stitch intervals, but may be disposed at two stitch intervals or interchanged every two stitches, for example.

In this embodiment, the following effects are obtained.

(1) Yarn jumps do not occur even when the boundary of an intarsia pattern jumps discontinuously.

(2) Knitting can be performed without yarn jumps even when one of the patterns of an intarsia pattern protrudes by a single stitch width in the course direction.

(3) Pattern interchange occurring when knitting produced by another yarn is interposed between the outward route and return route of smoothing knitting can be prevented.

(4) A knit designing device and a knitting program which support this intarsia knitting can be obtained.

The invention claimed is:

1. A knitting method for an intarsia pattern executed in a section on a boundary of the intarsia pattern in which a yarn feeding end position of a yarn feeder on a current course and a yarn feeding resumption position of the yarn feeder on a following course differ in a knitting course direction, the method comprising the steps of:

performing smoothing knitting by causing the yarn feeder to perform a reciprocating motion in the section such that on an outward route, a part of stitches of a single course in the section is formed, and on a return route, a remainder of the stitches of the single course in the section is formed, whereby the stitches of the single course in the section is formed by the sum total of the outward route and the return route; and ensuring that knitting with another yarn feeder is not performed in the section between the outward route and the return route of the smoothing knitting.

2. The knitting method for the intarsia pattern of claim 1, wherein:

knitting is performed with at least a leading yarn feeder and a trailing yarn feeder;

in a section in which a pattern to be knitted with at least one of the leading yarn feeder and the trailing yarn feeder increases in the knitting course direction from a current course to a following course, a part of stitches in the section is formed on a current knitting course, and a remainder of the stitches in the section is formed on a following knitting course; and in a section in which a pattern to be knitted with at least one of the leading yarn feeder and the trailing yarn feeder decreases in the knitting course direction from a current course to a following course, a part of stitches in the section is formed on a current knitting course, and a remainder of the stitches in the section is formed on a following knitting course.

3. The knitting method for the intarsia pattern of claim 2, wherein in the section in which the pattern to be knitted with the leading yarn feeder increases in the knitting course direction from the current course to the following course, knitting on the current knitting course is performed excluding a part of stitches on the following course, whereupon the leading yarn feeder is returned and the part of the stitches of the following course is formed, and in the section in which the pattern to be knitted with the trailing yarn feeder decreases in the knitting course direction from the current course to the following course, the part of the stitches of the following course is formed on the following knitting course, whereupon the leading yarn feeder is returned and stitches of another following course in the section are formed by the leading yarn feeder.

4. The knitting method for the intarsia pattern of claim 1, wherein during knitting of the intarsia pattern in which a pattern A protrudes into a pattern B by a single stitch row width in a course direction, the smoothing knitting is performed by causing one yarn feeder selected from a pattern A yarn feeder and a pattern B yarn feeder to perform a reciprocating motion in a section corresponding to a length of the protruding portion, whereupon smoothing knitting is performed by causing the other yarn feeder of the pattern A yarn feeder and the pattern B yarn feeder to perform a reciprocating motion in the section corresponding to the length of the protruding portion.

5. A knitting fabric including an intarsia pattern, the fabric having a section in which a boundary of the intarsia pattern varies discontinuously, wherein a course comprising a part of stitches in the section and a course comprising a remainder of the stitches in the section are both formed on a stitch row of a course preceding the section to form a single course of the stitches in the section by the sum total of the course comprising the part of the stitches in the section and the course comprising the remainder of the stitches in the section.

6. The knitting fabric including the intarsia pattern of claim 5, wherein:

a pattern A protrudes into a pattern B by a single stitch row width in a course direction;

in a section corresponding to a length of the protruding portion, a row of stitches with one yarn of a pattern A yarn and a pattern B yarn is formed on a stitch row of a course preceding the section such that a course comprising a part of the stitches in the section and a course comprising a remainder of the stitches in the section to form a single course of the stitches in the section with the one yarn by the sum total of the course comprising the part of the stitches in the section and the course comprising the remainder of the stitches in the section; and a row of stitches with the other yarn of the pattern A yarn and the pattern B yarn is formed on a row of the single course of the stitches in the section with the one yarn such that a course comprising a part of stitches in the section and a course comprising a remainder of the stitches in the section to form a single course of the stitches in the section with the other yarn by the sum total of the course comprising the part of the stitches in the section and the course comprising the remainder of the stitches in the section.

7. A knit designing device, for converting a knitting fabric design into a knitting method for a knitting machine, comprising:

detecting means for detecting a section on a boundary of an intarsia pattern in which a yarn feeding end position of a yarn feeder on a current course and a yarn feeding resumption position of the yarn feeder on a following course differ in a knitting course direction; and smoothing means for generating a smoothing knitting command to cause the yarn feeder to perform a reciprocating motion in the detected section such that on an outward route, a part of a single course of stitches in the section is formed, and on a return route, a remainder of the single course of the stitches in the section is formed, whereby the single course of the stitches in the section is formed by the sum total of the outward route and the return route, wherein knitting with another yarn feeder is not performed in the section between the outward route and the return route.

8. The knit designing device of claim 7, wherein knitting is performed with at least a leading yarn feeder and a trailing yarn feeder, a knitting command is generated such that in a section in which a pattern to be knitted with at least one of the leading yarn feeder and the trailing yarn feeder increases in the knitting course direction from a current course to a following course, a part of stitches in the section is formed on a current knitting course, and a remainder of the stitches in the section is formed on a following knitting course, and a knitting command is generated such that in a section in which a pattern to be knitted with at least one of the leading yarn feeder and the trailing yarn feeder decreases in the knitting course direction from a current course to a following course, a part of stitches in the section is formed on a current knitting course, and a remainder of the stitches in the section is formed on a following knitting course.

9. The knit designing device of claim 8, wherein a knitting command is generated such that in a section in which the pattern to be knitted with the leading yarn feeder increases in the knitting course direction from the current course to the following course, knitting on the current knitting course is performed excluding a part of stitches on the following course, whereupon the leading yarn feeder is returned and the part of the stitches on the following course is formed, and a knitting command is generated such that in the section in which the pattern to be knitted with the trailing yarn feeder decreases in the knitting course direction from the current course to the following course, the part of the stitches of the following course is formed on the following knitting course, whereupon the leading yarn feeder is returned and stitches of another following course in the section are formed by the leading yarn feeder.

10. A knitting program encoded on a computer readable medium, the knitting program comprising: detecting command for detecting a section on a boundary of an intarsia pattern in which a yarn feeding end position of a yarn feeder on a current course and a yarn feeding resumption position of the yarn feeder on a following course differ in a knitting course direction; and smoothing command for generating a smoothing knitting command to cause the yarn feeder to perform a reciprocating motion in the detected section such that on an outward route, a part of a single course of stitches in the section is formed, and on a return route, a remainder of the single course of the stitches in the section is formed, whereby the single course of the stitches in the section is formed by the sum total of the outward route and the return route, wherein knitting with another yarn feeder is not performed in the section between the outward route and the return route.

11. The knitting program encoded on a computer readable medium of claim 10, wherein knitting is performed with at least a leading yarn feeder and a trailing yarn feeder, a knitting command is generated such that in a section in which a pattern to be knitted with at least one of the leading yarn feeder and the trailing yarn feeder increases in the knitting course direction from a current course to a following course, a part of stitches in the section is formed on a current knitting course, and a remainder of the stitches in the section is formed on a following knitting course, and a knitting command is generated such that in a section in which a pattern to be knitted with at least one of the leading yarn feeder and the trailing yarn feeder decreases in the knitting course direction from a current course to a following course, a part of stitches in the section is formed on a current knitting course, and a remainder of the stitches in the section is formed on a following knitting course.

12. The knitting program encoded on a computer readable medium of claim 11, wherein a knitting command is generated such that in a section in which the pattern to be knitted with the leading yarn feeder increases in the knitting course direction from the current course to the following course, knitting on the current knitting course is performed excluding a part of stitches on the following course, whereupon the leading yarn feeder is returned and the part of the stitches on the following course is formed, and a knitting command is generated such that in the section in which the pattern to be knitted with the trailing yarn feeder decreases in the knitting course direction from the current course to the following course, the part of the stitches of the following course is formed on the following knitting course, whereupon the leading yarn feeder is returned and stitches of another following course in the section are formed by the leading yarn feeder.

* * * * *